US009850092B1

(12) United States Patent
Bond

(10) Patent No.: US 9,850,092 B1
(45) Date of Patent: Dec. 26, 2017

(54) DISPOSABLE STRING LINE HOLDER

(71) Applicant: William Ralph Bond, Manassas, VA (US)

(72) Inventor: William Ralph Bond, Manassas, VA (US)

( * ) Notice: Subject to any disclaimer, the term of this patent is extended or adjusted under 35 U.S.C. 154(b) by 0 days.

(21) Appl. No.: 15/330,670

(22) Filed: Oct. 27, 2016

(51) Int. Cl.

| | |
|---|---|
| ***B65H 75/40*** | (2006.01) |
| ***B65H 75/44*** | (2006.01) |
| ***B65H 75/22*** | (2006.01) |
| ***B65H 75/28*** | (2006.01) |

(52) U.S. Cl.
CPC ..... *B65H 75/406* (2013.01); *B65H 75/22* (2013.01); *B65H 75/28* (2013.01); *B65H 75/4465* (2013.01)

(58) Field of Classification Search
CPC .... B65H 49/205; B65H 75/22; B65H 75/241; B65H 75/28; B65H 75/406; B65H 75/4465
See application file for complete search history.

(56) References Cited

U.S. PATENT DOCUMENTS

| | | | | |
|---|---|---|---|---|
| 1,579,886 A | | 4/1926 | Oxner | |
| 4,285,477 A | | 8/1981 | Oxendahl et al. | |
| 5,664,739 A | | 9/1997 | Black et al. | |
| 6,006,909 A | * | 12/1999 | Dunne | B65D 75/002 206/388 |
| 2013/0198966 A1 | * | 8/2013 | Bond | B43K 23/001 7/160 |

* cited by examiner

*Primary Examiner* — William E Dondero
(74) *Attorney, Agent, or Firm* — Palmer Patent Consultants, LLC; Palmer C. DeMeo

(57) ABSTRACT

This invention is about a string line holder, used by construction workers for aligning construction units, that is inexpensive to make because of its simplicity in structure and its material which string line holder, after the string line is used up or defrayed, can be completely disposed of and replaced by another inexpensive string line holder of the same structure. The string line holder is made from a cylindrically shaped reel or spool on which the string line is wound and has an elongated handle which can be entirely inserted within a cylindrical passageway through the reel or spool and can be partially withdrawn from the cylindrical passageway such that the reel or spool can be rotated around a portion of the elongated handle. The string line holder, including the reel or spool and the elongated handle, is constructed from an inexpensive material such as cardboard or plastic.

19 Claims, 3 Drawing Sheets

DISPOSABLE STRING LINE HOLDER

BACKGROUND OF THE INVENTION

1. Field of the Invention

The present invention relates to the use of an inexpensive, disposable, and easily rotatable string line holder for aligning construction units in masonry, carpentry or general construction work.

2. Description of the Related Art

String lines on reels or spools are conventionally used in construction work to provide a visible line by which the construction worker can use for aligning multiple construction units, e.g., bricks or cinder blocks, or for other construction work that require the alignment of a plurality of wooden planks or boards for, e.g., an outdoor deck.

One old and well known string-line holder is disclosed in U.S. Pat. No. 5,664,739 whereby a string line is wound on a spool or reel which is inserted onto a reusable, mechanically separable, plastic holder with a rotatable handle. The object of the string-line holder in this patent is to replace the spool or reel with another spool or reel onto the plastic holder once the line string on the original spool or reel is depleted or used up; the plastic holder being reusable.

Another old and well known string line holder is disclosed in U.S. Pat. No. 1,579,886 whereby a chalk line holder includes a spool 7 made of wood (as indicated by its cross hatching in FIG. 3) and a handle 11 with an elongated extension which is inserted within an elongated bore in the spool 7. The spool 7 has an elongated bushing 14 through said bore whereby the spool 7 may be rotated around the elongated extension of the handle 11. The handle 11 has a shoulder 13 near one end of the handle's elongated extension and a cotter pin 15 at the opposite end of the handle's elongated extension to maintain the rotatable spool 7 on the handle's elongated extension. One end of the spool 7 has a metallic bifurcated member 17 to prevent an unwinding of the cord 20 from the spool 7. Although this chalk line holder has a rotatable spool 7 it is not a simple structure to manufacture with its severable parts and appears to be intended for reuse.

Yet another old and well known string-line holder is disclosed in U.S. Pat. No. 4,285,477 whereby a construction line reel or spool 1 comprises a construction line 29 wound around a spool 27 mounted on a rigid shaft 7 with a rotatable handle 5. The patent discloses that the spool 27 and rotatable handle 5 may be constructed from wood or plastic. Although the patent discloses that the construction holder is inexpensive to make it still requires the construction worker to remove the construction reel or spool from the holder and replace it with a new or unused one whenever it is worn or spent which is time consuming.

Accordingly, it is an object of this invention to provide the construction worker with a string line holder which is inexpensive as well as being completely disposable when the string line is worn or spent due to a myriad of uses.

It is another object of this invention to provide a unique handle structure around which the reel or spool is rotatable.

SUMMARY OF THE INVENTION

Briefly, the invention provides a string line holder with a cylindrically shaped reel or spool on which a string line is wound being constructed of inexpensive material, i.e., cardboard or plastic, and wherein said reel or spool has an elongated cylindrical passageway there through for a substantially cylindrically shaped handle that can be slid in and out therefrom a predetermined distance and whereby said cylindrically shaped reel or spool is rotatable around the cylindrically shaped handle for unwinding the string line as needed. The inner elongated passageway has a means therein for prohibiting the cylindrically shaped handle from sliding all the way out from said elongated cylindrical passageway. The free end of the cylindrical handle has a slot therein for fixing the free end of the string line when, in one case, the string line holder is not deployed for use and, in other situations, when the string line holder is deployed for use.

BRIEF DESCRIPTION OF THE INVENTION

DESCRIPTION OF THE INVENTION

Figure 1:
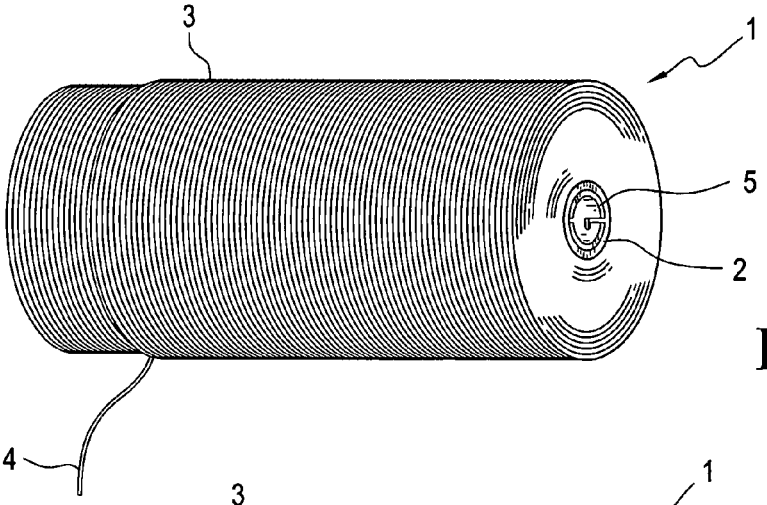
FIG. 1 is a perspective view of the string line holder for a cylindrically shaped string line reel or spool with a string line wound thereon and a handle completely inserted therein.
Figure 2:
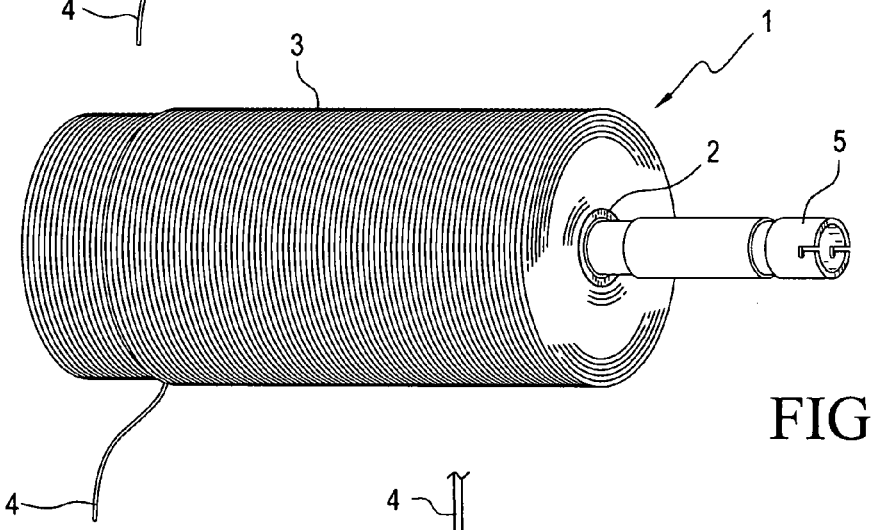
FIG. 2 is another perspective view of the string line holder of FIG. 1 with the handle extending from the cylindrically shaped string line reel or spool.
Figure 3:
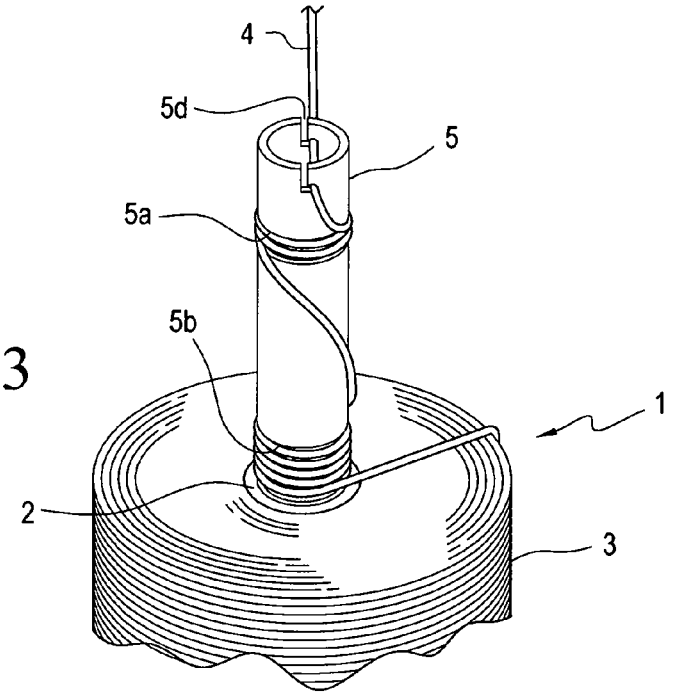
FIG. 3 is partial perspective view of the string line holder of FIG. 2 with the string line wrapped around the extended handle.

Referring to FIGS. 1, 2 and 3: In FIGS. 1 and 2, there are shown two different perspective views of the string line holder 1 of this invention. FIG. 1 shows a cylindrically shaped handle 5 completely inserted within a longitudinal passageway of the reel or spool 2. FIG. 2 shows a cylindrically shaped handle 5 extending substantially out from the reel or spool 2 when it is being deployed or used. Each of the handle 5 and the reel or spool 2 is approximately 6 inches long although each may be of longer or shorter length to accommodate a longer or shorter length of construction string. The string line 3 which is wrapped around the reel or spool 2 may be a heavy string, cord or other well-known material used for construction purposes. For the present invention, the string line 3 is conventionally between 300 to 350 feet long. The cylindrically shaped handle 5 (as shown in FIGS. 3 and 7) has circumferential indentures 5*a* and 5*b* the purposes of which will be explained later.

Figure 4:
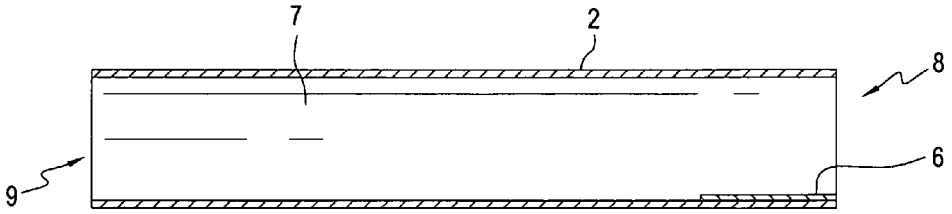
FIG. 4 is a longitudinal cross sectional view of the cylindrically shaped string line reel or spool without the string line wound thereon.
Figure 5:
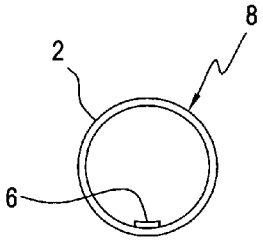
FIG. 5 is an end view at the distal end of the reel or spool shown in FIG. 4.
Figure 5A:
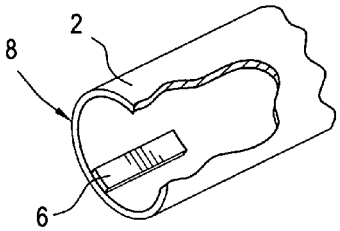
FIG. 5A is a partial perspective view of FIG. 4 with a cutaway section of the string line reel or spool.
Figure 6:
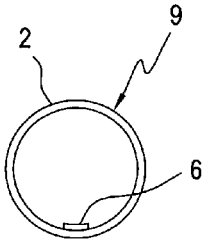
FIG. 6 is an end view at the proximal end of the reel or spool shown in FIG. 4.

Referring now to FIGS. 3, 4, 5, 5A and 6. The elongated, cylindrically shaped reel or spool 2 has a longitudinal cylindrically shaped passageway 7 there-through as shown in FIG. 4 and is preferably made from cardboard or plastic material, e.g., ABS, approximately 3/16 inch thick. At the distal end 8 of the reel or spool 2 there is an inner elongated strip 6 (approximately 1 inch long, ¼ inch wide and ⅛ inch thick) which strip 6 prevents the sliding handle 5 from being pulled completely out of the reel or spool 2 when the string line holder 1 is being used for alignment and also when it is not being used. The strip 6 abuts the inner wall of the reel or spool 2 and may be fabricated jointly with the cylindrically shaped reel or spool 2 or made separately and inserted within the distal end 8 of the reel or spool 2 and secured within the cylindrically shaped passageway 7 by an appropriate construction adhesive. FIG. 5 shows an end view of the reel or spool 2 at the distal end 8 thereof and FIG. 6 shows an end view of the reel or spool 2 at the proximal end 9 thereof. FIG. 5A is a perspective view showing how the strip 6 is fixed on the inner wall of the reel or spool 2 at the distal end 8 thereof. The cylindrically shaped reel or spool 2 is similar to the structure of a conventionally available string line reel or spool with the string line 3 wrapped thereon except for the strip 6 within the reel or spool 2. The reel or spool 2 including the strip 6 within the cylindrically shaped passageway 7 of this invention is made from cardboard by methods well known in the art. Alternatively, the reel or spool 2 may be made by methods well known in the art and the strip 6, also made of cardboard, may be made separately by methods well known in the art and subsequently secured within and to the distal end 8 of the reel or spool 2 by an appropriate constructive adhesive. FIG. 3 is a partially enlarged view of the string line holder 1 of this invention when it is in use or deployed. Also, when it is not in use, the end 4 of the string line 3 will be discontinuous and hanging freely at the distal end 10 (FIG. 7) of the cylindrically shaped handle 5. FIG. 3 also shows how the string line 3 is wound a few turns around the circumferential indentures 5*a* and 5*b* and then through the slit 5*d* at the distal end 10 of the handle 5 in either the deployed or non-deployed case. When the string line holder 1 is not in use, a nail (not shown) or other obstruction may be tied to the free end 4 of the string line 3 in order to prevent the string line 3 from slipping through the slit 5*d*.

Figure 7:
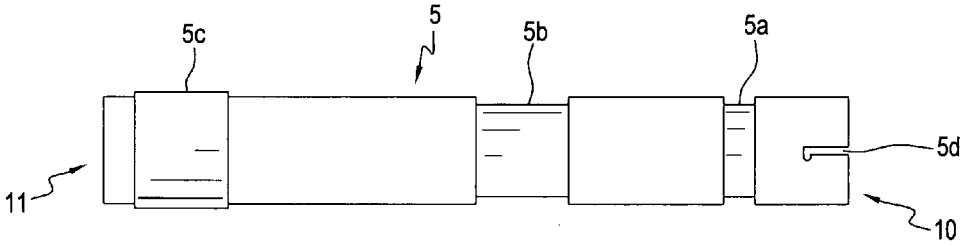
FIG. 7 is a side view of the cylindrically shaped handle with circumferential indentures therein, a slight enlargement at the proximal end thereof and a slit in the distal end thereof.
Figure 8:
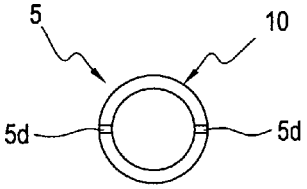
FIG. 8 is an end view at the distal end of the cylindrically shaped handle.
Figure 9:
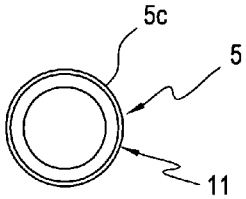
FIG. 9 is an end view at the proximal end of the cylindrically shaped handle.

Referring now to FIGS. 7, 8 and 9. The cylindrically shaped handle 5 is preferably hollow with an elongated passageway there through and is preferably made from cardboard the same material as the cylindrically shaped reel or spool 2. The cylindrically shaped handle 5 may also be solid and/or be made of plastic material, e.g, ABS (acrylonitrile butadiene styrene). The cylindrically shaped handle 5, which is approximately the same length as the reel or spool 2, has a circumferential first indenture 5*a* approximately ¼ inch long, 1/16 inch depth and approximately ¾ inch from the distal end 10 thereof. The cylindrically shaped handle 5 also has a second indenture 5*b* approximately ¾ inch long, 1/16 inch depth, and approximately 2 and ¼ inches from the distal end 10 thereof. The cylindrically shaped handle 5 also has an elongated cylindrical enlargement 5*c* approximately ¾ inch long, approximately ¼ inch from the proximal end 11 thereof which enlargement 11 acts to prevent the elongated handle 5 from sliding completely out from the reel or spool 2 when it abuts against the cylindrical strip 6 at the distal end 10 of the reel or spool 2. The outer diameter of the cylindrical enlargement 5*c* of the handle 5 has an outer diameter slightly less than the inner diameter of the major portion of the reel or spool whereby the elongated handle 5 can slide within the passageway 7 of the reel or spool 2 and slide mostly out from the reel or spool 2 as shown in FIGS. 2 and 3 of the drawings. The handle 5 also has a slit 5*d* there through approximately 3/16 inch depth from the distal end 10 with a width of approximately 1/16 inch or slightly less than the thickness of the string line 3 in order to secure the free end 4 of the string line 3 therein when the string line holder 1 is being deployed for use and also when the string line holder 1 is not being used. Also, there may be a small circular cavity offset from the bottom of the slit 5*d* to further secure the end 4 of the string line 3 within the slit 5*d*. The diameter of the circular cavity is of approximately the same diameter as the string line 3. FIGS. 8 and 9 show distal and proximate end views, respectively, of the handle 5.

Figure 10:
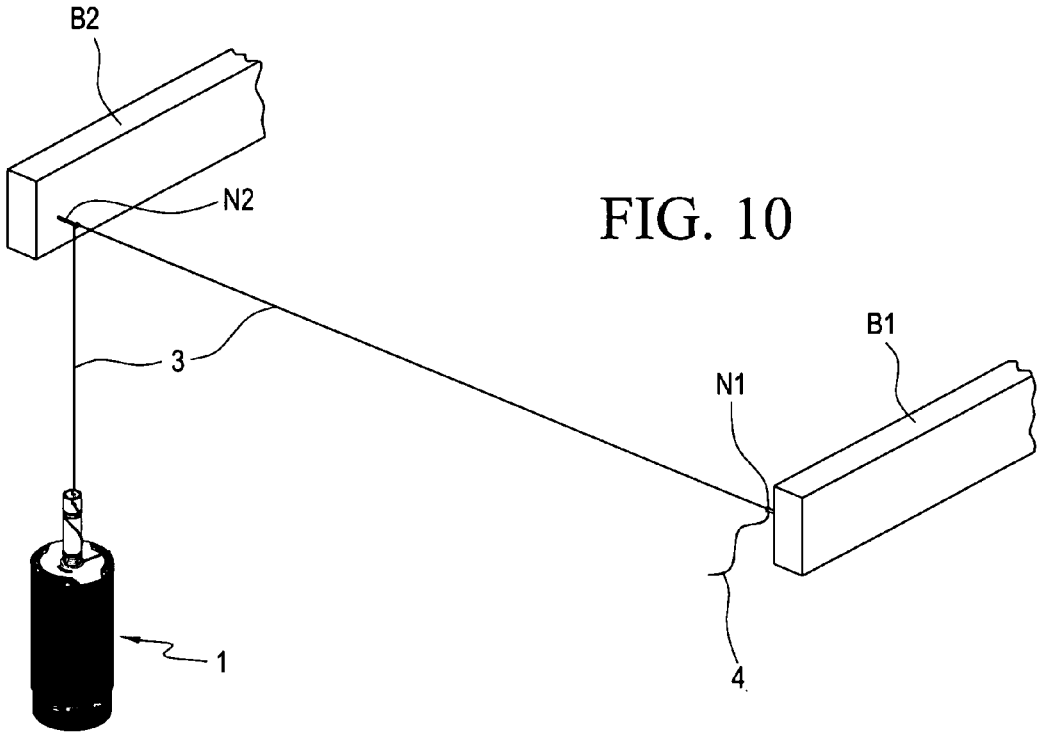
FIG. 10 is a perspective view of one example of the string line holder of this invention being deployed between two spaced boards.

FIG. 10 is a perspective view of one example of deploying the string line holder 1 of this invention for aligning the floor boards (not shown) for a deck.

In operation, the construction worker holds the string line holder 1 by the handle 5, with the handle being fully extended, and fixes the free end 4 of the string line 3 to the board B1 by an appropriate means such as a nail N1 and while firmly holding the extended handle 5 moves to the opposite board B2 causing the reel or spool 2 to rotate around the handle 5 and causing the string line 3 to unwind between board B1 and board B2 and then fixing the string line 3 to board B2 by an appropriate means such as a nail N2 by wrapping the string line 3 a couple of turns around nail N2 and then further wrapping the string line 3, a certain distance from nail N2, a few turns around each of the indentures 5*a* and 5*b of* the handle 5 and finally twisting the handle 5 clockwise to lock the handle 5 within the reel or spool 2 as shown in FIG. 10 as well as in FIG. 3. This maneuver is done by the construction worker, with one hand, twisting the handle 5 in a clockwise direction while firmly holding the reel or spool in a stationary position with the opposite hand. After this latter procedure is done the string line holder 1 will dangle from nail N2 as shown in FIG. 10.

After the alignment and fixing the construction units, e.g., bricks, cinder blocks, floor deck boards, etc., in place, the string line 3 is removed from the two fixing means such as nails N1 and N2 and then the string line 3 is completely unwound from the handle 5 and the excess string line 3 is rewound around the reel or spool 2 and thence around the two indentures 5*a* and 5*b* and through the slit 5*d*, as best shown in FIG. 3, with the string line end 4 closely spaced from the distal end 10 of the handle 5. The string line holder 1 will be retained in this position until the next construction alignment is needed. The string line holder 1 can be stored in a pocket of the construction worker's apron.

Figure 11:
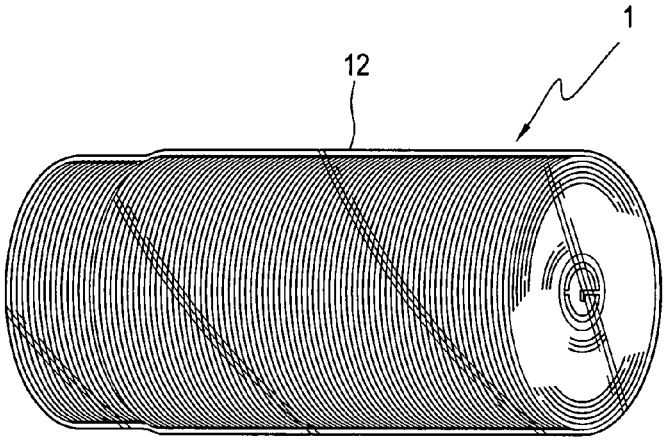
FIG. 11 is a perspective view of the string line holder enwrapped in a thin transparent plastic material as it would be sold in the stores.

FIG. 11 is a perspective view of the string line holder 1 tightly encapsulated within a transparent plastic material 12 such as cellophane as it might be sold from a store.

The manufacturing costs for making the string line holder 1 of this invention is estimated to be approximately $1:00-$1:50 which is considerably less than the cost for a conventionally sold string line holder which sells for between $5:00 and $7:00 thereby making it advantageously more reasonable, economically, to dispose of the string line holder 1 of this invention and purchase several others during the life time of one conventional string line holder.

The unique structure of the elongated, rotatable, cylindrically shaped reel or spool in combination with the elongated cylindrically shaped handle, as disclosed in this descriptive specification, can also be used for other purposes such as for X-mas wrapping, fabric, paper, or wire that is pre-wound on the reel or spool and that can be unwound in a limited amount, as needed. The size and length of the reel or spool as well as the length of the handle and the amount of the handle to be inserted into the elongated cylindrically shaped passageway of the reel or spool for deployment can be readily determined by one having ordinary skill in the art depending on the size and length of the selected material being wound on the reel or spool.

Modification of this invention will be readily apparent to those skilled in the art and it is intended that the invention be not limited by the embodiments disclosed herein but that the scope of the invention be defined by the appended claims.

What is claimed:

1. A string line holder comprising an elongated cylindrically shaped reel or spool with a cylindrically shaped passageway there through, wherein said elongated cylindrically shaped reel or spool has a proximal end and a distal end and means within the cylindrically shaped passageway for preventing said handle from being pulled completely out from said reel or spool, a string line enwrapped there around, an elongated cylindrically shaped handle being slidable within and slidable outside of said cylindrically shaped passageway of said reel or spool, said reel or spool being rotatable around said handle, and said reel or spool and said handle being made from cardboard or plastic.

2. The string line holder of claim 1 wherein said elongated cylindrically shaped handle has a proximal end and a distal end and wherein said means is an elongated strip within said cylindrically shaped passageway at the distal end of said cylindrically shaped reel or spool and a cylindrically shaped enlargement at the proximal end of said cylindrically shaped handle.

3. The string line holder of claim 2 wherein the size and length of said string line reel or spool as well as the length of said handle depend on the amount of string line to be used.

4. The string line holder of claim 3 wherein the length of said reel or spool and the length of said handle is approximately 6 inches.

5. The string line holder of claim 4 wherein said elongated strip has a length of approximately 1 and ¾ inch.

6. The string line holder of claim 5 wherein said elongated enlargement has a length of approximately ¾ inch.

7. The string line holder of claim 6 wherein said cylindrically shaped handle has a slit at the distal end of said cylindrically shaped handle for receiving and holding said string line therein.

8. The string line holder of claim 7 wherein said slit has a depth of approximately ½ inch.

9. The string line holder of claim 8 wherein said slit has an internal transverse space approximately slightly less than the thickness of said string line but sufficient enough to hold said string line in place.

10. The string line holder of claim 9 wherein said slit has a small circular cavity offset from the bottom of said slit to further secure the string line in said slit.

11. The string line holder of claim 2 wherein said cylindrically shaped handle has a first indenture near the distal end thereof and a second indenture at approximately midway between said distal and proximate ends thereof.

12. The string line holder of claim 1 wherein said string line holder has a transparent plastic material enwrapping said string line holder when said string line holder is completely non-deployed and ready for sale at a store.

13. The combination of an elongated cylindrically shaped reel or spool and a cylindrically shaped handle, said elongated cylindrically shaped reel or spool having an elongated cylindrically shaped passageway therethrough wherein said cylindrically shaped handle is wholly slidable within said cylindrically shaped passageway and partially slidable outside of said cylindrically shaped passageway whereby said cylindrically shaped reel or spool is rotatable around said cylindrically shaped handle, said cylindrically shaped reel or spool having a means within said cylindrically shaped passageway for preventing said cylindrically shaped handle from being slidable completely out from said reel or spool.

14. The combination of claim 13 wherein said cylindrically shaped passageway has a proximal end and a distal end and said cylindrically shaped handle has a proximal end and a distal end, said proximal and distal ends of said passageway and handle coinciding with each other, and wherein said means include a strip at said distal end of said cylindrically shaped passageway and a cylindrically shaped enlargement at the proximal end of said handle.

15. The combination of claim 14 wherein said strip has a length that is approximately ⅙th the length of said cylindrically shaped passageway and said cylindrically shaped enlargement has a length that is approximately slightly less than ⅙th the length of said elongated handle.

16. The combination of claim 15 wherein said strip has a thickness of slightly less than approximately 1/16th inch and wherein said enlargement has a thickness of approximately 1/16 inch.

17. The combination of claim 13 wherein said reel or spool is made from cardboard or plastic.

18. The combination of claim 17 wherein said handle is made from cardboard or plastic.

19. The combination of claim 18 wherein said strip is made from cardboard or plastic.

* * * * *